United States Patent [19]

Kinoshita

[11] Patent Number: 4,818,889

[45] Date of Patent: Apr. 4, 1989

[54] PINION STOPPER FOR ENGINE STARTER MOTOR

[75] Inventor: Takashi Kinoshita, Hyogo, Japan

[73] Assignee: Mitsubishi Denki Kabushiki Kaisha, Tokyo, Japan

[21] Appl. No.: 193,444

[22] Filed: May 12, 1988

[30] Foreign Application Priority Data

May 13, 1987 [JP] Japan ..... 62-117415
May 13, 1987 [JP] Japan ..... 62-117416

[51] Int. Cl.[4] ..... F02N 15/04
[52] U.S. Cl. ..... 290/48
[58] Field of Search ..... 290/28, 38 R, 48; 123/129 R

[56] References Cited

U.S. PATENT DOCUMENTS

| | | | |
|---|---|---|---|
| 3,663,825 | 5/1972 | Bowcott | 290/48 X |
| 3,791,685 | 2/1974 | Hamman | 290/48 X |
| 4,260,903 | 4/1981 | Mazzorana | 290/48 |
| 4,661,715 | 4/1987 | Volino | 290/48 |

*Primary Examiner*—Bernard Roskoski
*Assistant Examiner*—W. E. Duncanson, Jr.
*Attorney, Agent, or Firm*—Sughrue, Mion, Zinn, Macpeak and Seas

[57] ABSTRACT

A stopper member in the form of a pin or pins or a pair of ring halves having inner teeth is fixedly supported by a thrust spline and meshes with engaging grooves having a definite length and formed on an output portion of a planet shaft to limit an axial movement of a pinion.

4 Claims, 2 Drawing Sheets

PINION STOPPER FOR ENGINE STARTER MOTOR

BACKGROUND OF THE INVENTION

The present invention relates to an engine starter motor for an internal combustion engine and, particularly, a pinion stopper for the engine starter motor.

An example of a conventional pinion stopper is shown in Japanese Utility Model Publication No. 53727/1980 in which an output shaft which is rotated by a rotation of an armature of the motor is formed in a stepped portion thereof with a helical spline composed of mounting grooves and stopper grooves which are arranged in parallel and alternatively with respect to the mounting grooves. The stopper grooves are terminated at an axial position remote from an end of the output shaft so that they become effective only when a pinion is driven. Lands of spline on the side of an over-running clutch correspond in number to the mounting grooves and a dedendum circle of the spline has a diameter larger than that of the output shaft. When an over running clutch thrust mounted movably on the output shaft is moved axially until it is disengaged from the spline and returned to an original position after it is rotated by one pitch, a spline lands formed on an inner periphery of the thrust becomes coincident in position with the stopper grooves of the herical spline, so that they can be meshed when the thrust is moved forwardly. As means for preventing the thrust spline from escaping rearwardly to the side of the armature motor and for limiting a rearward movement of the thrust spline, a stopper ring is mounted on the output shaft.

With such construction, in order to make the stopper grooves of the helical spline formed on the output shaft coincident with the lands of the thrust spline, it is necessary to rotate the over running clutch thrust spline. Therefore, it is necessary to provide a relief space on the side of the output shaft which is large enough to allow such rotation of the thrust spline and to provide another stopper ring for preventing the thrust spline from dropping out rearwardly after the positional matching between the lands of the thrust spline and the stopper grooves of the helical spline is obtained. The provision of such relief space leads to an undesired increase of overall length of the device.

An object of the present invention is to provide a pinion stopper by which an axial length of a starting motor can be minimized.

SUMMARY OF THE INVENTION

According to the present invention, the above object is achieved by forming a pinion engaging portion within a helical spline and providing a stopper member fixed to an over running clutch. The stopper member protrudes into the engaging portion, so that an axial movement of the over running clutch is restricted. The pinion engaging portion may be at least one groove and the stopper member may be a pin. Alternatively, the pinion engaging portion may comprise a plurality of grooves arranged alternatively in parallel with driving grooves of the helical spline and the stopper member may comprise a pair of ring halves having inner spline whose number of teeth corresponds to that of the grooves. The ring halves may be prepared by cutting an annular inner splined ring.

Therefore, since the stopper member is always in the pinion engaging portion, the necessity of positional matching by rotating the over running clutch spline as in the conventional device is eliminated. Further, since it is unnecessary to rotate the over running clutch spline, it is unnecessary to provide such space as required by the conventional stopper device, resulting in a minimized overall length of the starting motor.

DETAILED DESCRIPTION OF THE PREFERRED EMBODIMENTS

Figure 1:
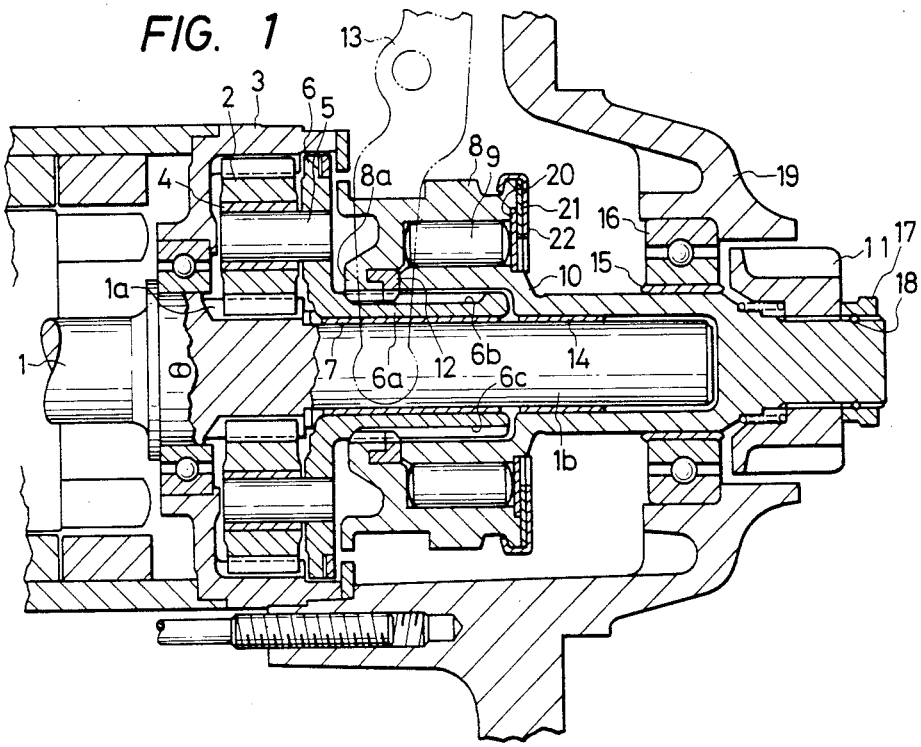
FIG. 1 is a cross sectional side view of an embodiment of the present invention.
Figure 2:
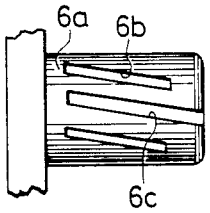
FIG. 2 is a side view of a portion thereof.

In FIG. 1 which shows an embodiment of the present invention in cross section and FIG. 2 which is a side view of an output shaft portion of a planet arm thereof, a solar gear 1*a* is provided on an output shaft 1 of an armature and meshes with planet gears 2 which mesh with an internal gear 3. The planet gears 2 are supported through sleeve bearings 4 by pins 5 pressure-inserted into arm portions of a planet arm 6. Rotational force of the armature output shaft 1 is transmitted through the solar gear 1*a* and the planet gears 2 to the planet arm 6, through helical spline 6*b* and 6*c* provided in an output shaft portion 6*a* of the planet arm 6 to a thrust spline 8 meshed therewith and then through rollers 9 and an over running clutch output shaft 10 to a pinion 11 fitted thereon. The helical spline provided on the output shaft portion 6*a* of the planet arm 6 includes at least one engaging groove 6*b* and driving grooves 6*c*. The pinion engaging groove 6*b* is arranged in parallel with the driving grooves 6*c*. Both ends of the engaging groove 6*b* are closed while a remote end of each driving groove 6*c* from the planet arm 6 is opened.

A stopper member 12 composed of a pair of ring halves 12*a* and 12*b*. prepared by dividing an annular ring having internal spline as shown in FIG. 2*a* is arranged in a remote end portion of an inner peripheral portion of a spline portion 8*a* of the thrust spline 8 from the planet arm 6 and engages with the spline 6*b*. The ring half 12*a* has a cross section shown in FIG. 2*b*. Since the spline teeth of the ring halves 12*a* and 12*b* engage with the engaging grooves 6*b*, a forward shift of the pinion 11 by a shaft lever 13 is restricted thereby. The number of lands of the helical spline of the spline portion 8*a* of the thrust spline 8 is equal to that of the driving grooves 6*c* of planet arm output shaft 6*a* and a diameter of dedendum circle of the helical spline is larger than an outer diameter of the planet arm output shaft 6*a*. The over running clutch output shaft 10 is supported through a sleeve bearing 14 by an extension 1*b* of the armature output shaft 1 and through a sleeve bearing 15 and a bearing 16 by a casing 19. In FIG. 1, reference numerals 17, 18, 20, 21 and 22 depict a stopper for restricting a movement of the pinion 11, a stopper ring, a positioning plate, a cushion rubber and a cover plate, respectively.

Figure 3A:
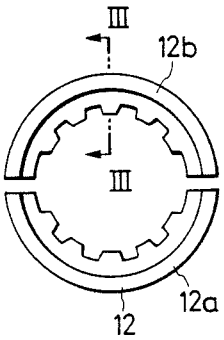
FIG. 3*a* is a plan view of a stopper member thereof.
Figure 3B:
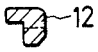
FIG. 3*b* is a cross section taken along a line III—III in FIG. 3*a;*
Figure 4:
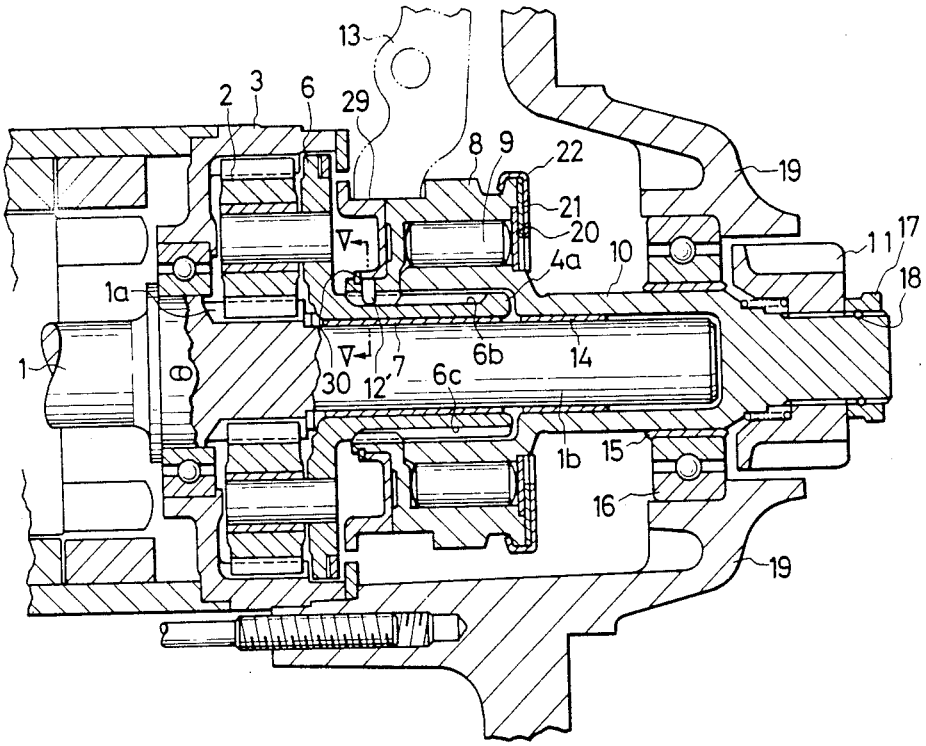
FIG. 4 is a cross sectional side view of another embodiment of the present invention.
Figure 5:
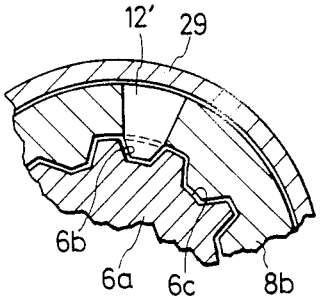
FIG. 5 is a cross section taken along a line V—V in FIG. 4.

Another embodiment is shown in cross section in FIG. 4. In FIG. 4, instead of the ring halves 12*a* and 12*b* of the embodiment in FIGS. 1 to 3, the stopper member takes in the form of a tapered pin or pins 12'. Further, a portion of the thrust spline 8 takes in the form of a separately prepared lever holder 29 fixedly secured thereto. The pin or pins 12' are fixedly held by the lever holder 29 and an inner portion **8*b* of the thrust spline 8 as shown in FIG. 5 which is a cross section taken along a line V—V in FIG. 4. The lever holder 29 function to prevent the pin or pins 12' from dropping and to keep the lever 13 engaged during a return movement of the pinion 11 and is held in its position by a stopper ring 30**.

As is clear from the foregoings, the stopper according to the present invention has no such space as that required in the conventional stopper to allow lands of the thrust spline to match in position to engaging grooves on the helical spline, and thus the overall length of the starter motor can be minimized.

What is claimed is:

1. In an engine starter motor including an output shaft adapted to be driven upon rotation of an armature, an over running clutch engaged with said output shaft through a helical spline formed on an inner peripheral surface of said over running clutch for moving a pinion axially to drive an engine and a pinion stopper provided on a portion of said output shaft for restricting a movement of said pinion, an improvement comprising said pinion stopper composed of a pinion engaging portion formed on a portion of said helical spline and a stopper member fixed to said over running clutch, said pinion engaging portion having opposite ends defining a definite axial length thereof on said portion of said helical spline, said stopper member being engaged with said pinion engaging portion slidably within said definite axial length of said pinion engaging grooves.

2. The improvement as claimed in claim 1, wherein said pinion engaging portion comprises at least a groove arranged in parallel with said helical spline grooves and extending within a length of said helical spline and wherein said stopper member is at least one pin.

3. The improvement as claimed in claim 1, wherein said pinion engaging portion comprises a plurality of grooves formed on said portion of said helical spline alternatively in parallel with said helical spline grooves and said stopper member comprises a plurality of said pins.

4. The improvement as claimed in claim 1, wherein said pinion engaging portion comprises a plurality of grooves formed on said portion of said helical spline alternatively in parallel to said helical spline grooves and said stopper member comprises a pair of ring halves having an inner spline having a corresponding number of teeth so that said teeth mesh with said grooves.

* * * * *